United States Patent [19]

Van der Togt

[11] Patent Number: 4,576,074

[45] Date of Patent: Mar. 18, 1986

[54] APPARATUS FOR SLICING BREAD PRODUCTS

[75] Inventor: Jacobus C. Van der Togt, Voorburg, Netherlands

[73] Assignee: B.V. Haagse Bakkerijmachinefabriek, Netherlands

[21] Appl. No.: 521,561

[22] Filed: Aug. 9, 1983

[30] Foreign Application Priority Data

Aug. 9, 1982 [NL] Netherlands ..... 8203143

[51] Int. Cl.[4] ..... B26D 5/00

[52] U.S. Cl. ..... 83/358; 83/367; 83/400; 83/425.2; 83/DIG. 1; 83/431; 83/751

[58] Field of Search ..... 83/58, 68, 278, 356.2, 83/358, 367, 365, 366, 399, 400, 425.2, 427, 431, 437, 751, DIG. 1; 16/52

[56] References Cited

U.S. PATENT DOCUMENTS

| | | | |
|---|---|---|---|
| 1,850,604 | 3/1932 | Rohwedder | 83/751 |
| 2,332,084 | 10/1943 | Jensen . | |
| 3,133,574 | 5/1964 | Reichel et al. . | |
| 3,875,840 | 4/1975 | Mooreman | 83/751 |
| 4,048,694 | 4/1977 | Newman et al. | 16/52 |

FOREIGN PATENT DOCUMENTS

| | | | |
|---|---|---|---|
| 0030061 | 11/1980 | European Pat. Off. . | |
| 223120 | 5/1909 | Fed. Rep. of Germany . | |
| 652156 | 10/1937 | Fed. Rep. of Germany | 34/210 |
| 1575105 | 7/1968 | France . | |
| 2438729 | 10/1978 | France . | |
| 670144 | 4/1952 | United Kingdom . | |
| 711292 | 11/1952 | United Kingdom . | |
| 1304292 | 11/1970 | United Kingdom . | |

*Primary Examiner*—James M. Meister
*Assistant Examiner*—John L. Knoble
*Attorney, Agent, or Firm*—Birch, Stewart, Kolasch & Birch

[57] ABSTRACT

An apparatus for slicing bread products or the like, provided with an oscillated driven cutting frame having parallel cutting strips, a supporting surface for the product to be cut leading to the frame, a propelling member movable across the surface and a housing enveloping the frame and propelling member, provided with a feed-in and a feed-off opening which, can be used by untrained operators or customers without any danger, in that the feed-off opening is located in the housing above the cutting frame.

4 Claims, 3 Drawing Figures

APPARATUS FOR SLICING BREAD PRODUCTS

BACKGROUND OF THE INVENTION

The invention relates to an apparatus for slicing bread products and as such, is provided with an oscillating cutting frame with parallel cuttingstrips, a supporting surface leading to the cutting frame for the product to be cut, a propelling member movable along the supporting surface and a housing comprising the cutting frame and propelling member, with a feed-in and feed-off opening for the product.

With the well-known devices of an apparatus for slicing bread products it is usual to place the product to be cut on the supporting surface at the back-side of the apparatus, after which the cut product appears on the front-side of the apparatus. This requires an uncomfortable position for the operator as the operator has to reach over or walk around the apparatus, whereby the pressing member has to be put back before or simultaneously with slicing. Moreover the cutting frames at the backside are, when putting back the pressing member, accessible and can be touched which could easily lead to injuries. Such a machine is therefore, not suitable for a free access by customers of bakery shops.

SUMMARY OF THE INVENTION

The purpose of the invention is to remove the above mentioned disadvantages and to provide an apparatus which can be used by untrained operators or customers without any danger.

The device according to the invention is distinguished in that the feed-off opening is provided above the cutting frame in the housing. Thus it is possible to easily take the product from the machine and wrap it up. Preferably the cutting frame extends in a flat or level plane. With this configuration it is possible for the product to be cut to be fed from the front and bottom side of the apparatus up through the cutting frames, such that when loading or discharging, it is no longer necessary to bend over or around the apparatus.

The propelling member manually attended in the conventional apparatus is according to the present invention, replaced by a propelling member which is loaded by means of a resilient force in the direction of the cutting frame against the action of a damping member. In this way the operator does not have to exercise a force on the propelling member and any type of bread can be sliced optimally.

Preferably the damping action of the damping member is controlled by a throttle member, by which the passing speed of the bread product can be adjusted to the type of bread. These and other characteristics of the invention will be described more fully by the following description and accompanying drawings.

BRIEF DESCRIPTION OF THE DRAWINGS

In the drawings is.

DETAILED DESCRIPTION

Figure 2:
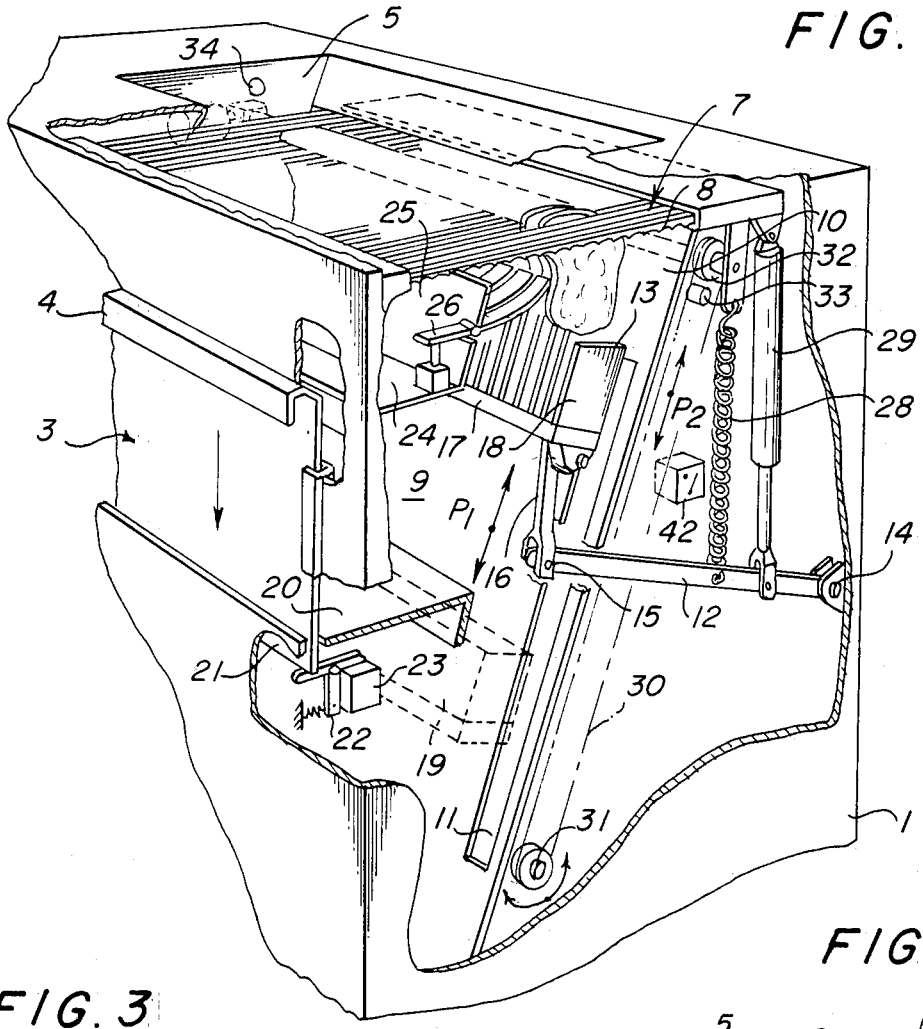
FIG. 2 a perspective view on an enlarged scale, with a partly removed housing of the device of FIG. 1, and FIG. 3 a schematic picture of an electro-hydraulic controlling system in the device according to FIG. 1.
Figure 1:
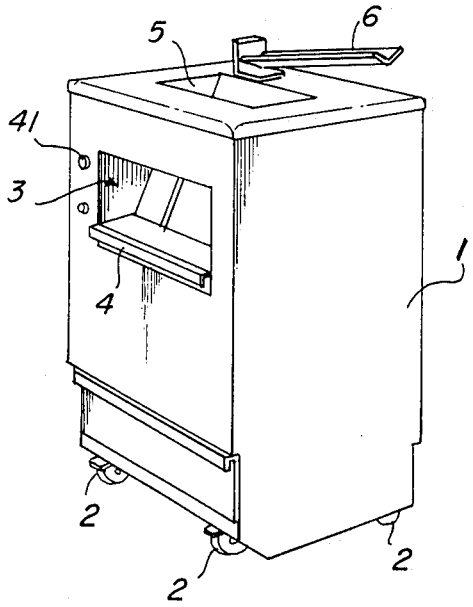
FIG. 1 a perspective view of the device according to the invention.

The device as shown in the figures consists of a rectangular casing or housing 1 which is movable on castor wheels 2. At the front side of the housing an entrance or feed-in opening 3 is arranged, which can be closed by a slide or valve having a handle 4. In the topsurface of the apparatus the feed-off opening 5, and a support 6 for the sliced product to be wrapped is arranged.

In FIG. 2 a part of the side wall of the housing 1 is removed showing that the device is provided with a cutting frame 7 horizontally extending and positioned right under the feed off opening 5. The cutting frame 7 can be embodied in any suitable way, so that a conventional structure comprising a pair of frames can be fitted in opposite to each other, oscillated in such a manner so as to avoid inconvenient vibrations. The driving mechanism and cutting frame fall outside the scope of invention.

It is noted that the cutting edge of each cutting strip 8 is directed downwardly. Beneath the cutting frame a supporting surface 9 is arranged somewhat oblique and backwards such that the trailing edge thereof is adjacent the backside of the cutting frame. In the supporting surface an oblong throughhole 11 is located accomodating a lever arm 12 of the propelling member 13. The lever is supported at pivot 14 in the housing and at its opposite end pivotably connected to a linkage 16 leading to the propelling member 13. The propelling member itself comprises a support plate 17 substantially horizontally extending and having a plurality of plates 18 in parallel relationship to each other so as to be able to move each plate 18 into the spacings between the parallel cutting strips 8. The propelling member 13 is movable in the direction of the arrow P1 upward and downward respectively, which will be explained in more detail with reference to FIG. 3. The lower position is indicated by broken line 19 in FIG. 2. From the lower position a guiding member 20 leads to the lower edge of the feed in opening 3. The feed in opening is closed by means of a slide-plate 4 having a handle. The lower edge 21 of the slide-plate actuates a T-like spring loaded levermember 22 adapted to set a switch 23. The plate 4 is locked by a locking means 43 (FIG. 3) against casual opening.

Parallel to the guiding member 20 a protecting plate 24 having a upstanding flange 25 is arranged on the level of the upper edge of the feed in opening 3. In the flange 25 a grid-like sensing member 26 is pivotably mounted, which sensing member is adapted to set a switch located on the plate 24.

The lever arm 12 is loaded permanently in the upwards direction by a tensioning spring 28 supported in the housing 1. Parallel to the spring a damping member 29, like a hydraulic cylinder, is arranged. At the backside of the support plate 9 an endless flexible member 30 is led over a pair of rollers 31 and 32, which rollers are rotatably supported in the plate 9. The flexible member 30 is provided with a fixed notch 33 protuding so as to be able to contact the arm 12. The flexible member 30 is moved by a motor in an upwards and downwards direction respectively according to arrow P2.

Above the cutting frame 7 and in the feed-off opening is arranged a detecting means 34 such as a light sensitive cell.

The working of the above described apparatus will be further explained with reference to FIG. 3. Assuming that the slide plate 4 is in the rest or lower position, a loaf can be freely inserted into the machine unhindered. In this position the slide plate 4 actuates the switch 23 and the machine will not work. As soon as the product to be cut, like a loaf of bread, is placed upon the guide 20 by the operator and is shifted as deep as possible against the support surface 9, then the loaf will rest upon the propelling member 13 being in the lowest position according to line 19 in FIG. 2.

Closing the slideplate 4 will set the switch 23, whereupon the motor 35 of the cutting frame 7 is actuated and a coil controlled valve for the damping member 29 in the hydraulic control system is set, such that a free flow of oil to a sump 37 is allowed, whereas notch 33 will move upward and leverarm 12 is set free. Further slideplate 4 is locked mechanically in its closed position. Thereby the spring 28 will move the propelling member unhindered upwards at a relative high speed, taking along the loaf to be cut. As soon as the loaf contacts the sensing means 26 the switch 27 will be set, which will reset the electro-magnetic valve 36, obstructing the free flow of oil to sump 37. The oil can flow through throttle-opening 38 of the hydraulic system only, whereby the upward movement of the propelling member 13 will be damped in order to diminish the propelling speed. The lower speed will be sufficient for an uninterrupted cutting action.

The propelling member will urge the bread product completely through the cutting frame 7, bringing the product, now cut, above the cutting frame and into the feed-off opening 5. The light sensitive member 34 will be actuated and the motor 35 through switch 42 will be stopped, thereby stopping the cutting frame 7 as well.

Figure 3:
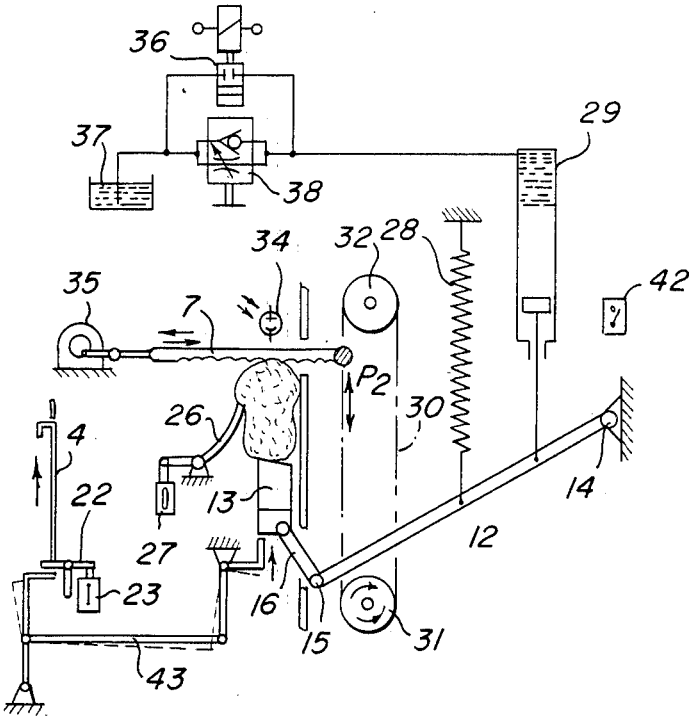

Taking the loaf out of the feed-off opening 5 and putting it upon the arm support 6 for packing, causes the light sensitive member 34 to be reset, so actuating the motor for the endless flexible member 30 in counter clockwise direction, see FIG. 3. The notch 33 urges the lever arm 12 downwards, which is done without any damping action since the oil can flow freely from the sump 37 trough one-way valve 40 into cylinder 29. As soon as the propelling member is brought back its lowest position according to line 19 in FIG. 2, the motor of the endless fexible member will stop whereupon the slide plate 4 is unlocked and falls down.

The apparatus is now again ready for the next cutting action.

From the above description it will be seen that the apparatus is easy to handle and moreover is foolproof. The cutting frame is accessible only at the "blunt" side on top. The slide plate can be opened only when the cutting action is definitely ended or the apparatus must be in the start position again.

The driving system for the propelling member 13 assures that the cutting process can be performed rather fast, due to the high speed movement of said propelling member 13 when the spring is not damped. The cutting speed itself can be adapted to any type of bread by means of the throttle opening 38, which can be set by knob 41.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An apparatus for slicing breadproducts or the like, comprising a substantially horizontal oscillated driven cutting frame having parallel cutting strips, a support surface for said product to be cut leading to said cutting frame, a member for propelling said product movable across said surface said propelling member being loaded by means of a resilient force towards said frame opposite to action of a damping member, said propelling means being further adapted to be reset, opposite to a spring action, by a reset motor controlled by a detecting means positioned above said cutting frame.

2. An apparatus for slicing breadproducts or the like comprising a substantially horizontal oscillated driven cutting frame having parallel cutting strips, a support surface for said product to be cut leading to said cutting frame, a member for propelling said product movable across said surface said propelling member being loaded by means of a resilient force towards said frame opposite to action of a damping member said damping action being controlled by a throttle member having arranged parallel thereto a bypass which can be closed by a switch valve controlled by a sensing means positioned near said cutting frame.

3. Apparatus as claimed in claim 2, characterised in that said sensing means is embodied like a grid.

4. An apparatus for slicing breadproducts or the like, comprising a substantially horizontal oscillated driven cutting frame having parallel cutting strips, a support surface for said product to be cut leading to said cutting frame, a member for propelling said product movable across said surface, and a housing enveloping said frame and propelling member, said housing being provided with a feed-in and feed-off opening respectively for said product, said feed-in opening adapted to be shut off by a closing member which can be locked by said propelling member, said feed-off opening being located in said housing above said cutting frame.

* * * * *